United States Patent [19]

Ohshima

[11] Patent Number: 5,048,395

[45] Date of Patent: Sep. 17, 1991

[54] CONTROL DEVICE FOR CYLINDER

[75] Inventor: Kazumi Ohshima, Saitama, Japan

[73] Assignee: Kayaba Industry Co. Ltd., Japan

[21] Appl. No.: 499,031

[22] Filed: Mar. 26, 1990

Related U.S. Application Data

[63] Continuation of Ser. No. 214,526, Jul. 1, 1988, abandoned.

[30] Foreign Application Priority Data

| | | | |
|---|---|---|---|
| Jul. 7, 1987 | [JP] | Japan | 62-104160 |
| Jul. 7, 1987 | [JP] | Japan | 62-104161 |
| Oct. 26, 1987 | [JP] | Japan | 62-163449 |
| Oct. 26, 1987 | [JP] | Japan | 62-163450 |
| Oct. 28, 1987 | [JP] | Japan | 62-164810 |
| Dec. 10, 1987 | [JP] | Japan | 62-187958 |

[51] Int. Cl.[5] ..... F15B 11/08; F15B 13/044

[52] U.S. Cl. ..... 91/447; 91/445; 91/451; 91/459; 91/461

[58] Field of Search ..... 91/445, 446, 447, 461, 91/420, 459, 451; 137/596.13, 596.2

[56] References Cited

U.S. PATENT DOCUMENTS 4,955,461 9/1990 Keir ..... 91/447 X

*Primary Examiner*—Edward K. Look
*Assistant Examiner*—John Ryznic
*Attorney, Agent, or Firm*—Steinberg & Raskin

[57] ABSTRACT

A control device for a cylinder including a spool type valve which includes a spool and is formed therein with a cylinder port. In the spool type valve is arranged an operation check valve for permitting only flowing of fluid to the cylinder. An orifice is formed so as to communicate a pilot chamber of the operation check valve and the cylinder port with each other. The spool is formed with a first control port and a second control port for selectively carrying out communication between the pilot chamber and the return passage. Thus, when the spool is moved to communicate the first control port with the pilot port, the pilot chamber is communicated with the return passage. This causes fluid to flow through the orifice to lead to a difference in pressure between both sides of the orifice, resulting in a poppet of the operation check valve being opened.

3 Claims, 3 Drawing Sheets

CONTROL DEVICE FOR CYLINDER

This is a continuation of application Ser. No. 214,526, filed July 1, 1988, now abandoned.

BACKGROUND OF THE INVENTION

1. Field of the Invention

This invention relates to a control device for a cylinder, and more particularly to a control device for controlling lowering motion of a cylinder of a forklift truck or the like.

2. Description of the Prior Art

A conventional control device for a cylinder of such type is disclosed in U.S. Pat. No. 4,099,541 and generally constructed in a manner as shown in FIG. 1. More particularly, the conventional control device includes a spool type valve 1 which includes a spool 1*a* and is provided therein with a cylinder port 2. The cylinder port 2 of the spool type valve 1 is connected to a bottom-side chamber 3 of a cylinder C of a forklift truck. Also, in the cylinder port 2 is arranged an operation check valve 4 in such a manner that a poppet 4*a* of the operation check valve 4 defines a pilot chamber 5 therein. The pilot chamber 5 is provided therein with a spring 6, which acts to press against the poppet 4*a* with a seat 7. When the poppet 4*a* is pressed abutted against the seat 7, the cylinder port 2 is divided into a spool-side section 2*a* and a cylinder-side section 2*b*.

The poppet 4*a* is formed with an orifice 8, through which the cylinder-side section 2*b* is communicated with the pilot chamber 5. The pilot chamber 5 is constantly communicated with a pilot passage 9, which is closed with a pilot valve 10. More particularly, the pilot valve 10 includes a poppet 10*a*, which is pressed against a seat 12 by means of a spring 11, to thereby close the pilot passage 9. The so-constructed pilot valve 10 is adapted to be contacted at a tip end thereof with a tapered portion 13 formed at an intermediate section of the spool 1*a*. When the spool 1*a* is moved in a left direction in FIG. 1, the pilot valve 10 is raised along the tapered portion 13 of the spool 1*a*, to thereby open the seat 12. This results in the pilot passage 9 being communicated with a return passage 15 via a through-hole 14 formed in the pilot valve 10.

In the conventional control device constructed as described above, when the spool 1*a* is at a neutral position shown in FIG. 1, the pilot valve 10 is closed to keep the operation check valve 4*a* closed, so that load W of the cylinder C is kept at the position.

Then, when the spool 1*a* is moved from the position in a right direction in FIG. 1, the pilot valve 10 is kept closed. However, an inflow passage 16 is communicated with the spool-side section 2*a* of the cylinder port 2 to cause pressure fluid to flow through the inflow passage 16 to the spool-side section 2*a*. The pressure fluid then opens the operation check valve 4, resulting in being supplied to the bottom-side chamber 3 of the cylinder C.

On the contrary, when the spool 1*a* is moved from the position in a left direction in FIG. 1, the pilot valve 10 is raised along the tapered portion 13 of the spool 1*a* with the movement of the spool 1*a* to open the seat 12, resulting in the pilot passage 9 being communicated with the return passage 15. Such communication between the pilot passage 9 and the return passage 15 causes a difference in pressure to occur between both sides of the orifice 8 to lead to opening of the poppet 4*a*.

Further movement of the spool 1*a* in the left direction causes communication between the spool-side section 2*a* of the cylinder port 2 and the return passage 15 through an annular groove 17 of the spool 1*a*, so that fluid in the bottom-side chamber 3 of the cylinder C is returned from the cylinder port 2 through the return passage 15 to a tank to decrease the load of the cylinder C.

When a timing of opening of the pilot valve 10 is delayed, the operation check valve 4 is caused to open after communication between the cylinder port 2 and the return passage 15. Such delayed opening of the operation check valve 4 causes fluid to suddenly flow from the cylinder C to the return passage 15 concurrently with the opening of the valve 4 resulting in inching control and the like being difficult.

Accordingly, in the conventional control device, it is required to accurately determine a relative position between the pilot valve 10 and the tapered portion 13 of the spool 1*a* in order to prevent a timing of opening of the operation check valve from being delayed. Unfortunately, accurate determination of the relative position requires working the pilot valve and spool with high accuracy to cause an increase in the manufacturing cost of the device. Also, the conventional control device requires to separately arrange the pilot valve, so that the number of parts is significantly increased. This results in a further increase in the manufacturing cost.

SUMMARY OF THE INVENTION

The present invention has been made in view of the foregoing disadvantages of the prior art.

Accordingly, it is an object of the present invention to provide a control device for a cylinder which is capable of opening an operation check valve without providing any pilot valve to decrease the number of parts.

It is another object of the present invention to provide a control device for a cylinder which is capable of opening an operation check valve at a precise timing.

It is a further object of the present invention to provide a control device for a cylinder which is capable of accomplishing the above-described objects with a simple structure.

In accordance with the present invention, a control device for a cylinder is provided. The control device includes a spool type valve including a spool movably arranged therein. The spool type valve is formed therein with a cylinder port and provided with an operation check valve on a side of the cylinder port. The operation check valve is adapted to permit only flowing of fluid in a direction from the device to the cylinder. Also, the spool type valve is formed therein with an orifice for communicating a pilot chamber of the operation check valve and the cylinder port with each other. The spool type valve is also formed therein with a return passage, which is communicated with the pilot chamber of the operation check valve in association with movement of the spool of the spool type valve. The spool is formed with relay passage through which the cylinder port and return passage are communicated with each other. Further, in the present invention, a pilot passage is formed in the spool type valve for communicating the pilot chamber with the spool, and a control passage is formed in the spool so that it may be communicated with the pilot passage in association with movement of the spool. The control port is communicated with the pilot passage in advance of communication between the cylinder port and the return port.

In the present invention constructed as described above, when the spool is moved in a predetermined direction, the pilot chamber of the operation check valve is communicated with the return passage, so that a poppet of the operation check valve is opened by pressure on a side of the cylinder. Then, further movement of the spool causes the cylinder port to be communicated with the return passage to reduce load of the cylinder. Thus, it will be understood that the control device of the present invention is capable of eliminating a pilot valve required in a conventional control device and accurately determining a timing of control so far as positional relationships between the control passage of the spool and the through passage of the spool are accurately determined.

BRIEF DESCRIPTION OF THE DRAWINGS

These and other objects and many of the attendant advantages of the present invention will be readily appreciated as the latter becomes better understood by reference to the following detailed description when considered in connection with the accompanying drawings.

DETAILED DESCRIPTION OF THE PREFERRED EMBODIMENTS

Figure 1:
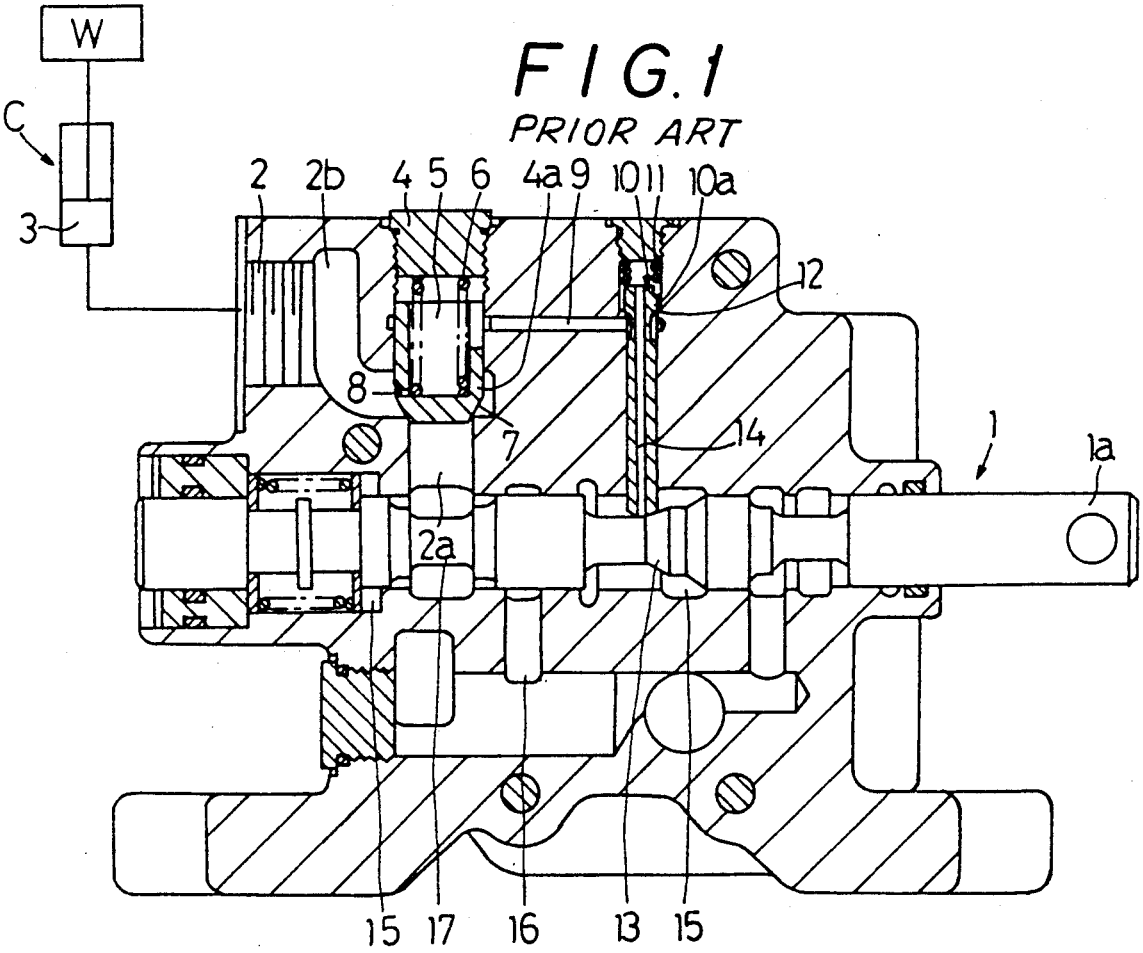
FIG. 1 PRIOR ART
FIG. 1 is a sectional view showing a conventional control device for a cylinder.

Now, a control device for a cylinder according to the present invention will be detailedly described hereinafter with reference to FIGS. 2 to 9, wherein like reference numerals designate like or corresponding parts throughout.

Figure 2:
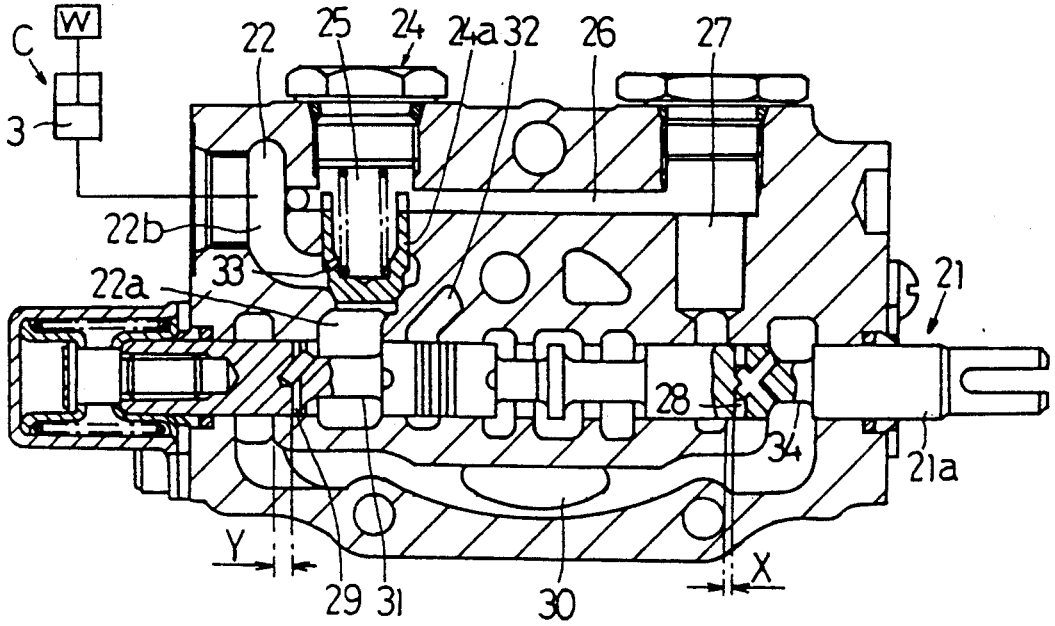
FIG. 2 is a sectional view showing a first embodiment of a control device for a cylinder according to the present invention.
Figure 3:
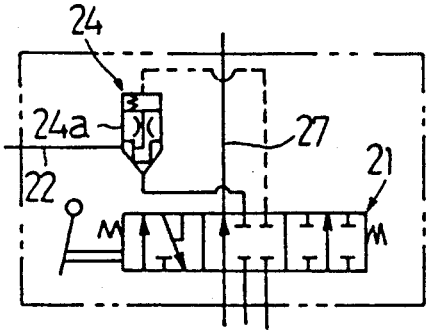
FIG. 3 is a circuit diagram of the control device shown in FIG. 2.

FIGS. 2 and 3 show a first embodiment of a control device for a cylinder according to the present invention. A control valve of the illustrated embodiment is so constructed that a spool type valve 21 is connected at its cylinder port 22 to a bottom-side chamber 3 of a cylinder C and an operation check valve 24 is arranged in the cylinder port 22 to divide an interior of the cylinder port 22 into a spool-side section 22*a* and a cylinder-side section 22*b*.

A pilot chamber 25 of the operation check valve 24 is communicated through a pilot passage 26 with a pilot passage 27. Also, a spool 21*a* of the spool type valve 21 is formed therein with a first control passage 28 and a second control port 29.

The first control port 28 is constantly communicated with a second annular groove 34 formed on the spool 21*a*. Also, the first control passage 28 is cut off from communication with the pilot passage 27 when the spool 21*a* is at a neutral position shown in FIG. 2. Then, when the spool 1*a* is moved in a left direction in FIG. 2, the first control port 28 is communicated with the pilot passage 27 to accomplish communication between the pilot port 27 and the return passage 30.

The second control port 29 is constantly communicated with a first through passage 31 formed on the spool 21*a*. Also, it is cut off from communication with the return passage 30 when the spool 21*a* is at the position shown in FIG. 2. Movement of the spool 21*a* in the left direction causes the second control port 29 to be communicated with the return passage 30.

Also, in the control device of the illustrated embodiment, a distance Y between a position of the first control passage 28 shown in FIG. 2 and a position of the port 28 at which the first control port 28 is communicated with the pilot passage 27 is determined to be larger than a distance X between a position of the second control port 29 shown in FIG. 2 and a position of the port 29 at which the second control port 29 is communicated with the return passage 30.

When the spool 21*a* is moved in the right direction in FIG. 2 from the neutral position shown in FIG. 2, the spool-side section 22*a* of the cylinder port 22 is communicated through the first annular groove 31 with a supply passage 32, so that pressure fluid opens a poppet 24*a* of the operation check valve 24. This causes the fluid to be supplied to the bottom-side chamber 3 of the cylinder C to increase load W of the cylinder.

Subsequently, when the spool 21*a* is returned to the neutral position shown in FIG. 2, the supply passage 32 is cut off from communication with the spool-side section 22*a* of the cylinder port 22 to stop supply of the pressure fluid to the bottom-side chamber 3 of the cylinder C. Also, at this time, the poppet 24*a* of the operation check valve 24 is closed by the action of pressure on a side of the cylinder C, so that the load W of the cylinder C is kept at the position.

Then, when the spool 21*a* is moved in the left direction in FIG. 2, the first control port 28 is first opened. Opening of the first control port 28 causes fluid in the cylinder-side section 22*a* of the cylinder port 22 to flow from an orifice 33 formed at the poppet 24*a* of the operation check valve 24 to a return passage through the pilot chamber 25, pilot passage 26, pilot passage 27, first control port 28 and second annular groove 34 in turn.

When the spool 21*a* is further moved in the left direction, the second control port 29 is first communicated with the return passage 30. This causes fluid in the bottom-side chamber 3 of the cylinder C to flow to the return passage 30 while being constricted by the second control passage 29. Such constriction of fluid by the second control port 29 causes a speed at which the cylinder C is lowered to be limited. This permits inching control in the second control port 29 to be accomplished.

When the spool is still further moved in the left direction, the cylinder port 22 is communicated through the first annular groove 31 with the return passage 30, so that the fluid may be smoothly flowed to the return passage 30 without being constricted by the second control port 29, to thereby increase the lowering speed of the cylinder C.

Figure 4:
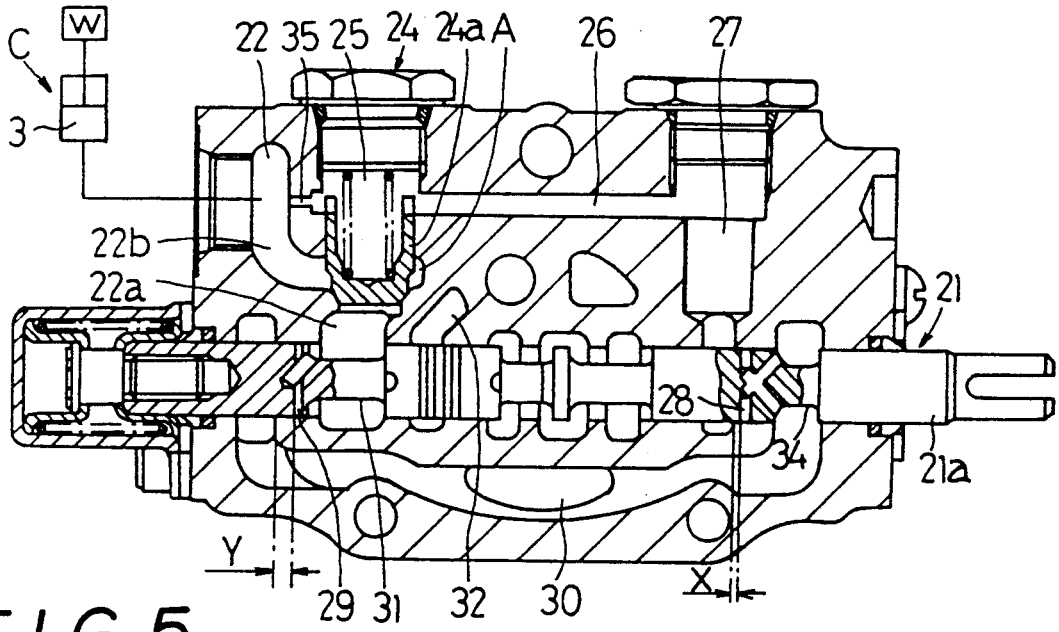
FIG. 4 is a sectional view showing a second embodiment of a control device for a cylinder according to the present invention.

FIG. 4 shows a second embodiment of a control device for a cylinder according to the present invention. A control device of the second embodiment is constructed in substantially the same manner as the first embodiment described above, except that a cylinder-side section 22*b* of a cylinder port 22 is formed with an orifice 35 communicated with a pilot chamber 25.

In the second embodiment of FIG. 4, a poppet 24*a* of an operation check valve 24 is free of any orifice. Accordingly, the orifice 35 is kept at a constant position irrespective of rotation of the poppet 24*a*, to thereby prevent the orifice 35 from being positioned on a side of a flow path pocket A.

When the poppet 24*a* is opened, fluid flowing from a spool-side section 22*a* of the cylinder port 22 to the cylinder-side section 22*b* passes through the flow path pocket A in a manner to travel about the poppet 24*a*. However, the flow path pocket A is formed into a small area, so that the pressure loss occurs in fluid flowing through the flow path pocket A to cause an increase in pressure in the flow path pocket A.

Assuming that the poppet 24*a* is provided with an orifice, high pressure in the flow path pocket A is applied through the assumed orifice to the pilot chamber 25 to increase pressure in the pilot chamber 25 when the assumed orifice is positioned on the side of the flow path pocket A under such conditions as described above. The so-applied high pressure acts to close the poppet 24*a* to increase flow resistance in the cylinder port 22.

However, in the second embodiment, the poppet 24*a* is not provided with any orifice as described above. Also, the orifice 35 of the cylinder-side section 22*b* of the cylinder port 22 is kept at a constant position, so that it may be prevented from being moved toward the flow path pocket A.

Figure 5:
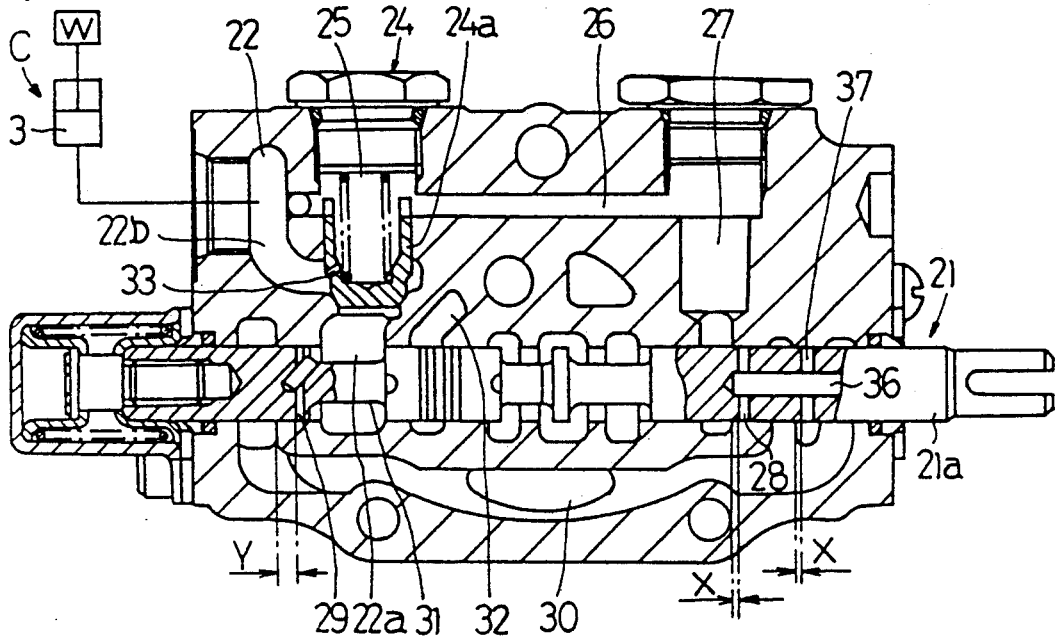
FIG. 5 is a sectional view showing a third embodiment of a control device for a cylinder according to the present invention.

FIG. 5 shows a third embodiment of a control device for a cylinder according to the present invention, wherein a spool 21*a* is formed with a first control port 28 and a flow path 37 communicating through a communication hole 36 with the first control port 28. When the spool 21*a* is at a position shown in FIG. 5, the first control passage 28 and flow path 37 are kept closed. At this time, a distance X between a position of the first control port 28 shown in FIG. 5 and a position of the port 28 at which it is communicated with a pilot passage 27 and a distance X between a position of the flow path 37 shown in FIG. 5 and a position of the path 37 at which it is communicated with a return passage 30 are determined in the same manner as in the first embodiment described above. Thus, the pilot port 27 is closed with both the first control port 28 and flow path 37, to thereby significantly reduce leakage of fluid therethrough.

The remainder of the third embodiment may be constructed in substantially the same manner as the first embodiment described above.

Figure 6:
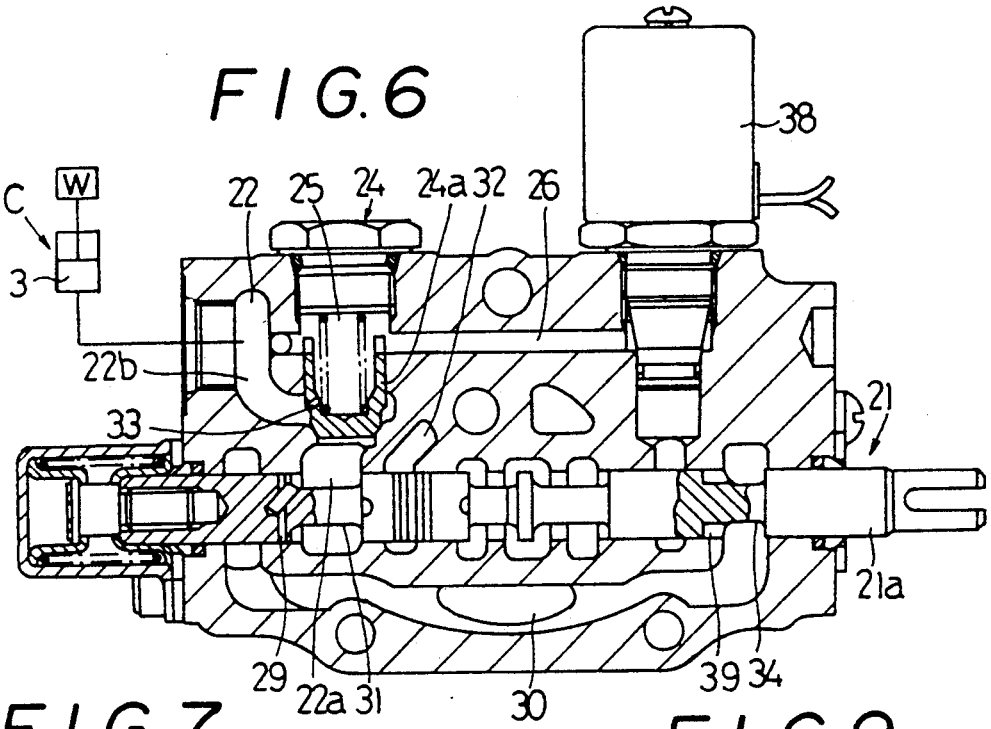
FIG. 6 is a sectional view showing a fourth embodiment of a control device for a cylinder according to the present invention.
Figure 7:
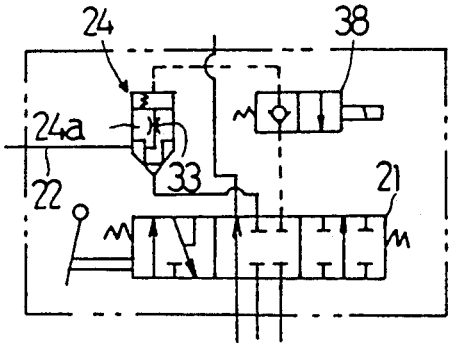
FIG. 7 is a circuit diagram of the control device shown in FIG. 6.

FIGS. 6 and 7 show a fourth embodiment of a control device for a cylinder according to the present invention, wherein a pilot passage 27 is provided with an electromagnetic on-off valve 38. Arrangement of the on-off valve 38 at the pilot port 27, so far as the on-off valve 38 is closed, keeps the pilot passage 27 closed to keep an operation check valve 24 closed even when a spool 21*a* is misoperated. Thus, the fourth embodiment effectively prevents reduction of load W of a cylinder C due to misoperation of the spool 21*a*.

Also, in the fourth embodiment, a first control passage is constituted by a notch 39. The remainder of the fourth embodiment may be constructed in substantially the same manner as the first embodiment described above.

Figure 9:
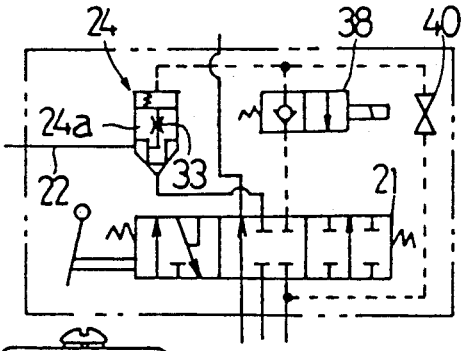
FIG. 9 is a circuit diagram of the control device shown in FIG. 8.
Figure 8:
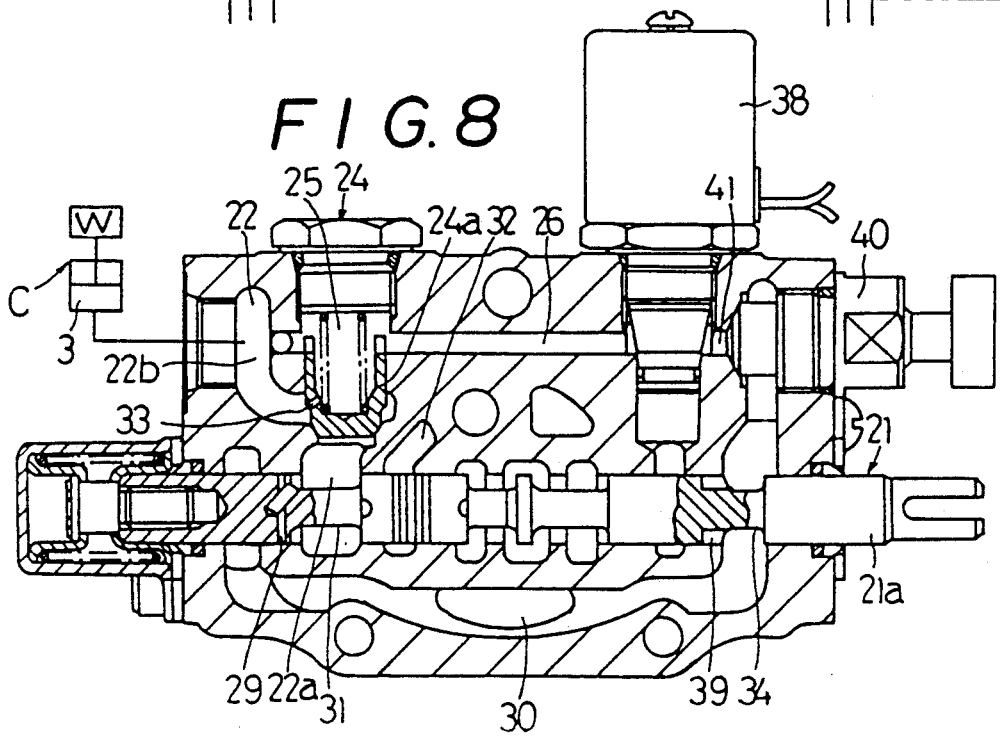
FIG. 8 is a sectional view showing a fifth embodiment of a control device for a cylinder according to the present invention.

A fifth embodiment of a control device for a cylinder according to the present invention is shown in FIGS. 8 and 9. In the fifth embodiment, a pilot passage 26 constructed as in the fourth embodiment is provided with a manually operable emergency valve 40, so that when the emergency valve 40 is opened, the pilot passage 26 is communicated through a by-pass passage 41 with a return passage 30. Such communication between the pilot passage 26 and the return passage 30 causes the same results as opening of the electromagnetic on-off valve 38 in the fourth embodiment described above, so that a poppet 24*a* may be opened.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A control device for a cylinder comprising:

a housing;

a cylinder port formed in said housing;

an operating check valve provided with a pilot chamber and arranged in said housing on a side of said cylinder port, said operating check valve being adapted to permit only flowing of fluid to the cylinder;

an orifice for communicating said pilot chamber of said operation check valve and said cylinder port with each other;

a spool type valve including spool slidably arranged in said housing;

a through passage formed at said spool of said spool type valve;

a return passage communicated through said through passage with said cylinder port in association with movement of said spool;

a first control port formed in said spool, said first control port being closed at the neutral position of said spool and open to a side of a pilot passage in association with movement of said spool to carry out communication between said pilot passage and said return passage and blocking of the communication; and a second control port formed in said spool, said second control port being closed at the neutral position of said spool and communicated with said return passage in association with movement of said spool;

said first control port being communicated with said pilot passage prior to opening of said second control port to a side of said return passage and communicating said cylinder port and said return passage with each other through said through passage after said second control port is open to said return passage.

2. A control device as defined in claim 1, wherein said pilot passage is provided with an electromagnetic on-off valve.

3. A control device as defined in claim 1, wherein said spool type valve is formed with a by-pass passage for communicating said pilot chamber with said return passage and provided with an emergency valve for operating said by-pass passage.

* * * * *